US008126339B2

(12) United States Patent
Mizuyama

(10) Patent No.: US 8,126,339 B2
(45) Date of Patent: Feb. 28, 2012

(54) IMAGE FORMING APPARATUS, INTERMEDIATE TRANSFER BELT DRIVE CONTROL METHOD, COMPUTER PROGRAM, AND RECORDING MEDIUM

(75) Inventor: Tetsuhiko Mizuyama, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 392 days.

(21) Appl. No.: 12/481,755

(22) Filed: Jun. 10, 2009

(65) Prior Publication Data

US 2009/0310986 A1 Dec. 17, 2009

(30) Foreign Application Priority Data

Jun. 12, 2008 (JP) ..... 2008-154286

(51) Int. Cl.
*G03G 15/01* (2006.01)

(52) U.S. Cl. ..... 399/31; 399/302; 399/308

(58) Field of Classification Search ..... 399/31, 399/121, 126, 66, 302, 308, 313, 388, 397
See application file for complete search history.

(56) References Cited

U.S. PATENT DOCUMENTS 6,385,409 B2 * 5/2002 Suzuki et al. ..... 399/66
6,529,695 B2 * 3/2003 Katayanagi et al. ..... 399/66
6,674,989 B1 * 1/2004 Kusaba et al. ..... 399/302
6,711,367 B2 * 3/2004 Saito et al. ..... 399/121
7,054,586 B2 * 5/2006 Kuroda ..... 399/302
7,113,714 B2 * 9/2006 Taguchi et al. ..... 399/66
7,447,453 B2 * 11/2008 Kim et al. ..... 399/66
7,885,589 B2 * 2/2011 Fukuyama et al. ..... 399/302
2008/0005453 A1 1/2008 Mizuyama

FOREIGN PATENT DOCUMENTS

JP 2001-201994 7/2001

* cited by examiner

*Primary Examiner* — Susan Lee
(74) *Attorney, Agent, or Firm* — Oblon, Spivak, McClelland, Maier & Neustadt, L.L.P.

(57) ABSTRACT

An image forming apparatus includes a primary transfer unit, a secondary transfer unit, a belt drive unit, and a swingable assembly. The primary transfer unit primary transfers an image from an image carrying member to an intermediate transfer belt. The secondary transfer unit secondary transfers the image, primary-transferred onto the intermediate transfer belt, from the intermediate transfer belt to a recording medium. The belt drive unit drives the intermediate transfer belt. The swingable assembly alternately abuts the secondary transfer unit to the intermediate transfer belt and separates the secondary transfer unit from the intermediate transfer belt. When the image forming apparatus is determined to be shifted to an extended stop mode, the belt drive unit moves the intermediate transfer belt for a given distance in a transport direction of the intermediate transfer belt and the swingable assembly separates the secondary transfer unit from the intermediate transfer belt.

18 Claims, 9 Drawing Sheets

IMAGE FORMING APPARATUS, INTERMEDIATE TRANSFER BELT DRIVE CONTROL METHOD, COMPUTER PROGRAM, AND RECORDING MEDIUM

CROSS-REFERENCE TO RELATED APPLICATIONS

This application claims priority to Japanese Patent Application No. 2008-154286, filed on Jun. 12, 2008 in the Japan Patent Office, the entire contents of which are hereby incorporated by reference herein.

BACKGROUND OF THE INVENTION

1. Field of the Invention

The present invention relates to an image forming apparatus, such as a copier, a printer, a facsimile, and multi-functional image processing apparatus having at least two of these functions, employing an intermediate transfer belt and a secondary transfer roller, a drive control method for the intermediate transfer belt of the image forming apparatus, a computer program for the drive control method executable by a computer, and a recording medium storing the computer program.

2. Description of the Background Art

Typically, image forming apparatuses using electrophotography employ an intermediate transfer system to form full color images, in which an image formed on an intermediate transfer belt is transferred to a recording sheet (used as recording medium) using a secondary transfer mechanism. In such intermediate transfer system, a plurality of image forming engines (typically four) are arranged in tandem along a direction of movement of the intermediate transfer belt. Each one of the image forming engines forms a respective color image, and then each color image is sequentially transferred onto the intermediate transfer belt with a given order to form a superimposed color image (or full color image using four colors). The superimposed image is then transferred (or secondary transferred) to the recording sheet as a recording image.

JP-2001-201994-A describes an image forming apparatus using such intermediate transfer belt and secondary transfer mechanism, in which a revolver-type image forming engine is used.

In such image forming apparatus, the intermediate transfer belt is extended by a plurality of support rollers. Accordingly, if the apparatus is not used for an extended period of time, that is, if the intermediate transfer belt remains stopped at the same position for an extended period of time, eventually a portion of the intermediate transfer belt extended by the support rollers may eventually deform over time, and such extended portion may cause an undesirable phenomenon called curling. If curling occurs, an imaging failure may occur in the form of white bands appearing when an image is transferred in a primary transfer operation.

Here, an extended stop time, hereinafter also referred to as an extended stop mode, means a condition in which the intermediate transfer belt remains in the same position for an extended period of time, for example, when the image forming apparatus is stopped for a long period of time after a last image forming operation, or when the image forming apparatus is shifted to an energy-saving mode. As such, the extended stop time or extended stop mode means a condition in which the image forming apparatus does not conduct image forming operations for a long period of time.

JP-2001-201994-A describes an image forming apparatus including a belt member having one position mark for detecting a position of belt member, a detection sensor to detect the position mark of the belt member, a plurality of support members to rotatably support the belt member, and a drive unit to drive the belt member. Such a configuration is designed to prevent curling. Specifically, the belt member can be stopped at at least two different positions based on a detection result of the detection sensor and the drive unit, which controls a drive stop of the belt member.

In JP-2001-201994-A, the belt member can be stopped at at least two different positions, thus varying the stopped position of the belt member. However, if a stopping period becomes longer, a relative position of the belt member and support roller may not change during the stopping period, by which a portion of the belt member extended by the support roller may change its shape over time, and curling may occur.

In general, if the belt member and the support roller remain in contact with each other for a given time period, the belt member tends to deform in proportion to the length of time the belt member and the support roller remain in contact. Deformation of the belt member may be prevented or suppressed in the image forming apparatus described in JP-2001-201994-A because the belt member can be stopped at different positions set in advance. However, if the belt member stops at the same positions for a long period of time, curling may still occur at such contact portion of the belt member.

Further, in JP-2001-201994-A, curling cannot be detected until an image failure occurs, which may not be desirable for practical usage of the image forming apparatus.

SUMMARY

In one aspect of the present invention, an image forming apparatus includes a primary transfer unit, a secondary transfer unit, a belt drive unit, and a swingable assembly. The primary transfer unit primary transfers an image from an image carrying member to an intermediate transfer belt. The secondary transfer unit secondary transfers the image, primary-transferred onto the intermediate transfer belt, from the intermediate transfer belt to a recording medium. The belt drive unit drives the intermediate transfer belt. The swingable assembly alternately abuts the secondary transfer unit to the intermediate transfer belt and separates the secondary transfer unit from the intermediate transfer belt. When the image forming apparatus is determined to be shifted to an extended stop mode, the belt drive unit moves the intermediate transfer belt for a given distance in a transport direction of the intermediate transfer belt and the swingable assembly separates the secondary transfer unit from the intermediate transfer belt.

In another aspect of the present invention, a drive control method of an intermediate transfer belt for an image forming apparatus is devised. In the image forming apparatus, an image is primary transferred from an image carrying member to the intermediate transfer belt, and the image is secondary transferred from the intermediate transfer belt to a recording medium using a secondary transfer unit. The method includes the steps of moving and separating. The moving step moves the intermediate transfer belt for a given distance in a transport direction of the intermediate transfer belt when the image forming apparatus is determined to be shifted to an extended stop mode. The separating step separates the secondary transfer unit from the intermediate transfer belt after moving the intermediate transfer belt for a given distance in a transport direction of the intermediate transfer belt when the image forming apparatus is shifted to the extended stop mode.

In another aspect of the present invention, a computer-readable medium storing a program for controlling an intermediate transfer belt used for an image forming apparatus, comprising computer readable instructions, that when executed by a computer, that instructs a controller to carry out a drive control method of an intermediate transfer belt. In the image forming apparatus, an image is primary transferred from an image carrying member to the intermediate transfer belt, and the image is secondary transferred from the intermediate transfer belt to a recording medium using a secondary transfer unit. The method includes the steps of moving and separating. The moving step moves the intermediate transfer belt for a given distance in a transport direction of the intermediate transfer belt when the image forming apparatus is determined to be shifted to an extended stop mode. The separating step separates the secondary transfer unit from the intermediate transfer belt after moving the intermediate transfer belt for a given distance in a transport direction of the intermediate transfer belt when the image forming apparatus is shifted to the extended stop mode.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
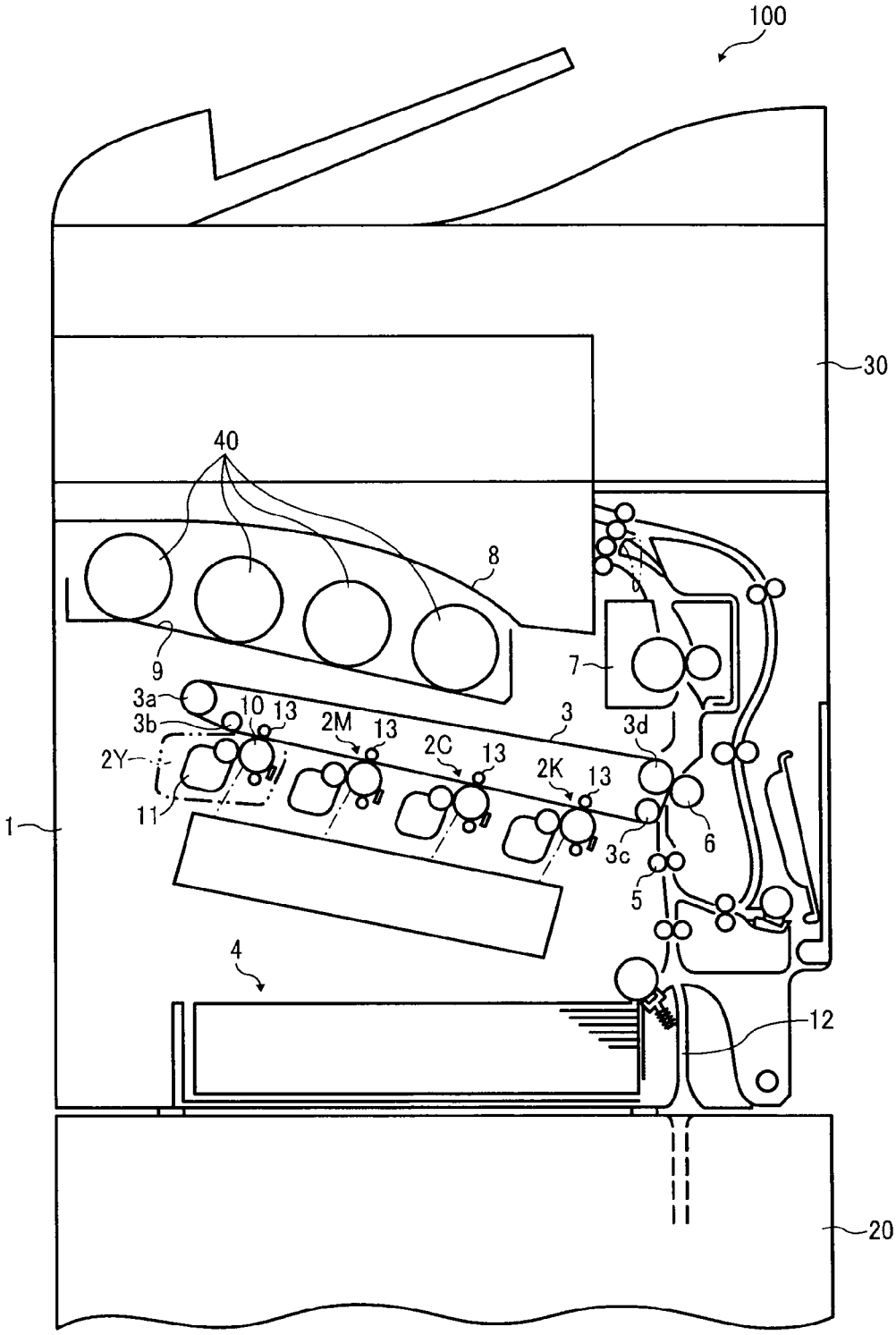
FIG. 1 shows a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described. The image forming apparatus may employ electrophotography, for example, and may be used as a copier, a printer, a facsimile, or a multi-functional imaging apparatus which may include several functions, but not limited thereto.

FIG. 1 shows a schematic configuration of an image forming apparatus 100 according to an exemplary embodiment. The image forming apparatus 100 may be a multi-functional image processing apparatus controlled by a digital processing system, but not limited thereto. The image forming apparatus 100 may be referred to as a multi-function peripheral MFP. The image forming apparatus 100 shown in FIG. 1 may be an image forming apparatus employing an indirect transfer type using image forming engines arranged in a tandem manner. The image forming apparatus 100 may include four image forming engines 2Y, 2M, 2C, and 2K, and an intermediate transfer belt 3 in an apparatus body 1, for example.

The image forming engines 2Y, 2M, 2C, and 2K may face the intermediate transfer belt 3, which may be an endless belt and extended by first and fourth support rollers 3*a*, 3*b*, 3*c*, and 3*d*, and may travel in a given direction. The image forming engines 2Y, 2M, 2C, and 2K may employ electro-photography method to form yellow toner image, magenta toner image, cyan toner image, and black toner image on a photoconductor 10 provided for each of the image forming engines 2Y, 2M, 2C, and 2K. As such, the photoconductor 10 may be used as an image carrying member. Such toner images are then sequentially transferred from the photoconductor 10 to the intermediate transfer belt 3 using a primary transfer roller 13 provided for each of the image forming engines 2Y, 2M, 2C, and 2K. The primary transfer roller 13 may be disposed at a position facing the photoconductor 10 by interposing the intermediate transfer belt 3 between the primary transfer roller 13 and the photoconductor 10. The primary transfer roller 13 is used as a primary transfer unit.

The image forming apparatus 100 may further include a sheet tray 4, which stores a given volume of recording sheets. A recording sheet fed from the sheet tray 4 one by one is transported to a registration roller 5 through a transport path. The registration roller 5 stops the recording sheet for a moment and then feeds the recording sheet to a nip between the intermediate transfer belt 3 and a secondary transfer roller 6. When the recording sheet passes through the nip between the intermediate transfer belt 3 and the secondary transfer roller 6, the toner images formed on the intermediate transfer belt 3 are transferred to the recording sheet. The recording sheet is then transported to a fixing unit 7, in which heat and pressure is applied to the recording sheet to fix the toner images on the recording sheet. Then, the recording sheet is ejected to an ejection tray 8.

The image forming apparatus 100 may further include a cartridge section 9 under the ejection tray 8 and above the intermediate transfer belt 3. The cartridge section 9 includes a toner cartridge 40, which stores toner to be supplied to a development unit 11 in the image forming engine 2. The toner cartridge 40 may be detachably mounted in the cartridge section 9.

The image forming apparatus 100 may be placed over a sheet feed unit 20, and the image forming apparatus 100 may include an image scanner 30 having an automatic document feeder at its upper portion. The image scanner 30 is used to scan a document. The sheet feed unit 20 includes a plurality of sheet trays stacked in a vertical direction. A recording sheet is picked up from the sheet tray by a sheet feed roller, then separated by a separation roller one by one, and then guided to a transport path in the sheet feed unit 20 by a transport roller. Then, the recording sheet is further guided to a transport path 12 in the image forming apparatus 100. The recording sheet guided in the transport path 12 is transported to the registration roller 5. The registration roller 5 feeds the recording sheet to the nip between the intermediate transfer belt 3 and the secondary transfer roller 6 to form a image on the recording sheet as above described. Accordingly, the secondary transfer roller 6 is used as a secondary transfer unit.

The image scanner 30 may include a scan unit and an automatic document feeder, for example. The scan unit may employ a flat bed system or a sheet-through system to scan document image, and the automatic document feeder feeds document sheets one by one to a scan position of the scan unit. The scanned image data or information is converted to digital data, and transmitted to the image forming apparatus 100. The image forming apparatus 100 forms an image on a recording sheet using the digital data prepared from the scanned image data. The sheet feed unit 20 and the image scanner 30 may employ a known mechanism.

Figure 2:
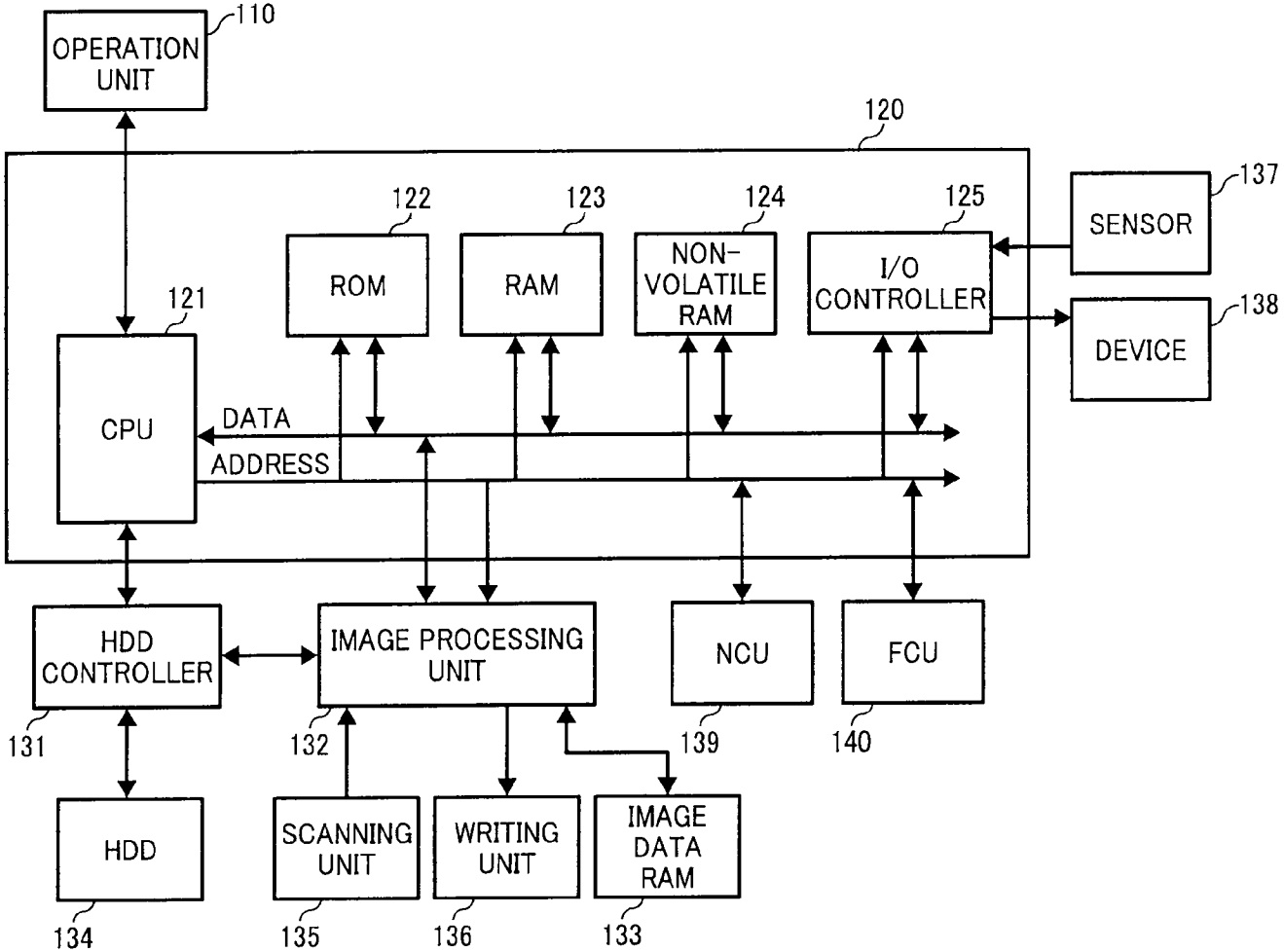
FIG. 2 shows a block diagram of a control system for the image forming apparatus of FIG. 1.

FIG. 2 shows a block diagram of a control system used for the image forming apparatus 100 according to an exemplary embodiment. The control system may include an engine control unit 120, an operation unit 110, an image processing unit 132, a hard disk drive 134 (HDD 134), a network control unit 139 (NCU 139), a facsimile control unit 140 (FCU 140), a sensor 137, and a device 138, for example, each of which may be connected each other via a bus.

The engine control unit 120 may include a central processing unit 121 (CPU 121), a read only memory (ROM) 122, a random access memory 123 (RAM 123), a non-volatile RAM 124, and an input/output (I/O) controller 125, for example. The ROM 122, RAM 123, non-volatile RAM 124, and I/O controller 125 may be connected to the CPU 121 via a data bus and an address bus, for example. The ROM 122 stores program codes of a program used by the CPU 121, and the CPU 121 uses the RAM 123 as a working area to execute the program. The non-volatile RAM 124 stores data, with which the CPU 121 may execute the program. The HDD 134 may be connected to the CPU 121 via a HDD controller 131, which is controlled by the CPU 121.

The image processing unit 132 may be connected to a scanning unit 135, a writing unit 136, and an image data RAM 133, for example. Image data scanned by the scanning unit 135 is input to the image processing unit 132, and then the image processing unit 132 inputs image data for writing to the writing unit 136.

Further, the image data RAM 133 temporarily stores image data scanned by the scanning unit 135, and the image processing unit 132 may read out image data temporarily stored in the image data RAM 133. Further, the image processing unit 132, connected to the HDD controller 131, may read out image data stored in the HDD 134, or the image processing unit 132 stores image data, which has received given image processing, to the HDD 134.

Further, the image forming apparatus 100 may include a concentration sensor (hereinafter, P sensor) at a position facing the intermediate transfer belt 3. The P sensor detects concentration of image patterns formed on the intermediate transfer belt 3, which will be described later. Using an output signal of the P sensor, the engine control unit 120 may conduct a process control including an image concentration control, and further conducts a belt failure analysis such as for example detection of undesirable phenomenon called curling of the intermediate transfer belt 3. The sensor 137 may include the P sensor, and the non-volatile RAM 124 stores given data used for the process control and detection process (e.g., curling phenomenon detection).

Figure 3:
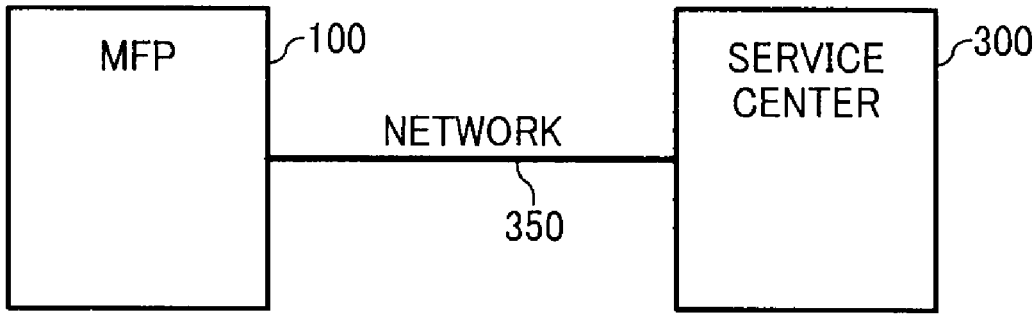
FIG. 3 is a block diagram showing a connection relationship of the MFP and a service center.

FIG. 3 shows a block diagram of a connection relationship of the image forming apparatus 100 and a service center 300, in which, the image forming apparatus 100 is connected to the service center 300 via a service center 350, and the image forming apparatus 100 and the service center 300 communicate data or information each other. For example, the image forming apparatus 100 may transmit information on failure determination or analysis such as for example detection of curling of the intermediate transfer belt 3 to the service center 300, and the service center 300 may transmit information on replacement timing of each of units. As described later, the CPU 121 (step S109) and the service center 300 may be used as a replacement indicator unit.

Figure 4:
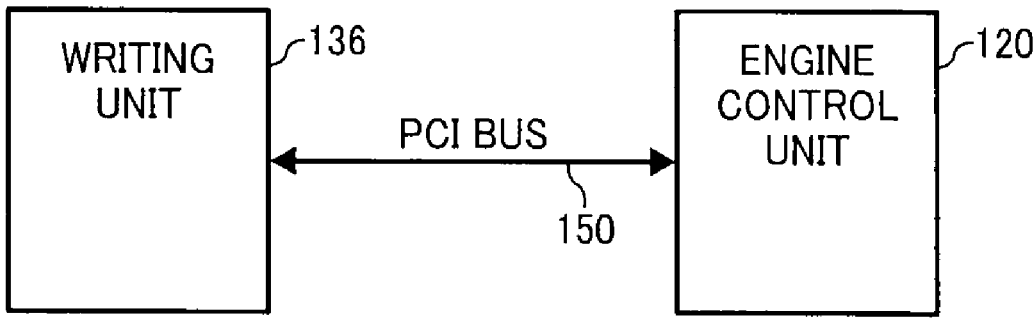
FIG. 4 is a block diagram showing a connection relationship of a writing unit and an engine control unit for the MFP.

FIG. 4 shows a block diagram of a connection relationship of the writing unit 136 and the engine control unit 120 in the image forming apparatus 100, in which the writing unit 136, used as an image forming engine, is connected to the engine control unit 120 via a PCI (peripheral component interconnect) bus 150. The writing unit 136 and the engine control unit 120 may communicate command information to conduct a given operation.

Figure 5:
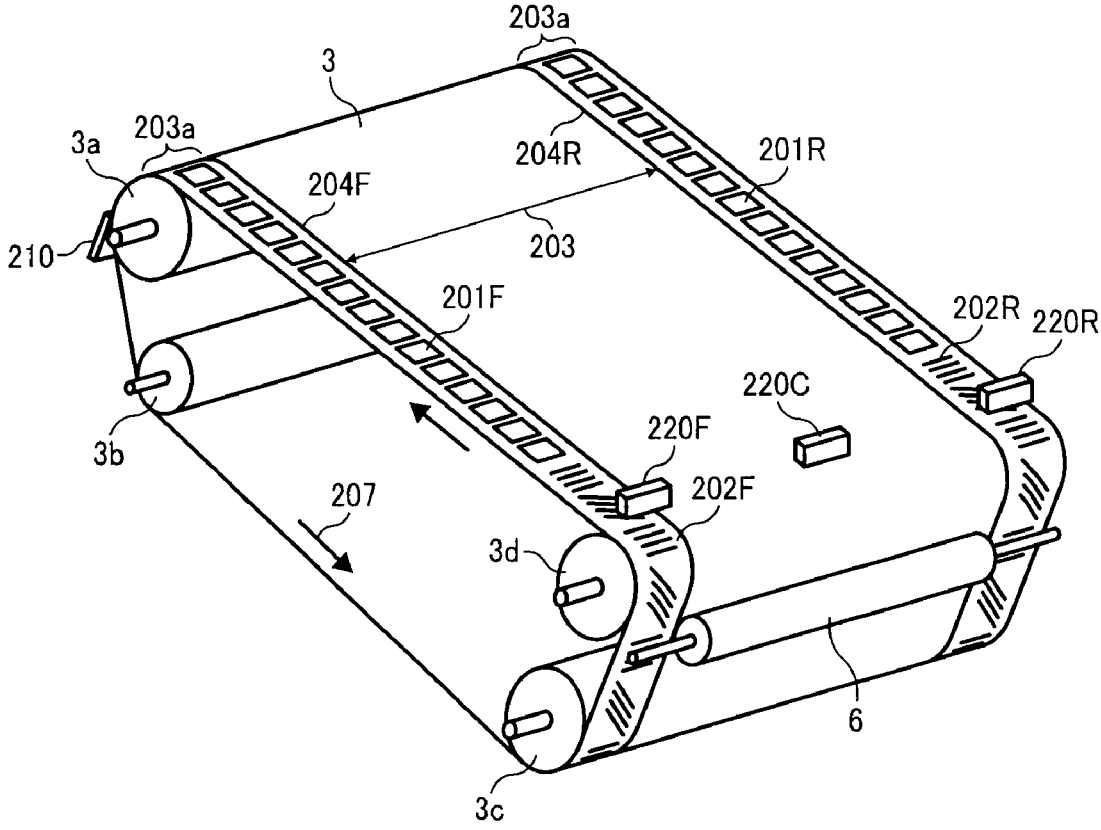
FIG. 5 shows a perspective view an intermediate transfer belt and its surroundings.

FIG. 5 shows a perspective view of the intermediate transfer belt 3 extended by the support rollers 3*a*, 3*b*, 3*c*, and 3*d*. The first support roller 3*a*, driven by a belt drive motor, functions as a drive roller. The belt drive motor is used as a belt drive unit. The second to fourth support rollers 3*b*, 3*c*, and 3*d* function as driven rollers, for example. The fourth support roller 3*d* and the secondary transfer roller 6 form a transfer nip by sandwiching the intermediate transfer belt 3 therebetween. A recording sheet may be transported to the transfer nip from the sheet tray 4 or the sheet feed unit 20 to transfer a toner image from the intermediate transfer belt 3 to the recording sheet.

As shown in FIG. 5, the intermediate transfer belt 3 includes an image forming area 203 at a center portion in a width direction of the intermediate transfer belt 3, and an image not-forming area 203*a* on both end side of the image forming area 203. In the image not-forming area 203*a*, concentration correction patterns 201F and 201R, and positional deviation correction patterns 202F and 202R, which are to be used for the above mentioned process control, are provided for each of colors. Further, in the image forming area 203, concentration correction patterns, and positional deviation correction patterns may also be provided for each of colors. Concentration correction patterns can be formed by using the writing unit 136 under a control of the CPU 121. As such, the writing unit 136 can be used as a concentration correction pattern forming unit.

Further, to detect the concentration correction patterns and the positional deviation correction patterns, P sensors 220F, 220C, and 220R may be disposed at given positions facing the concentration correction pattern, and the positional deviation correction pattern. As shown in FIG. 5, the P sensors 220F, 220C, and 220R may be disposed over the intermediate transfer belt 3, for example. As for the P sensors 220F, 220C, and 220R, the suffix F indicates a front side, the suffix C indicates a center portion, and the suffix R indicates a rear side. In FIG. 5, a left side is set as a front side, and three rows of patterns are formed, and the P sensors 220F, 220C, and 220R are disposed in a direction perpendicular to a traveling (or rotating) direction of the intermediate transfer belt 3. The P sensors 220F, 220C, and 220R may detect the concentration correction pattern and the positional deviation correction pattern formed along one-rotation length of the intermediate transfer belt 3. As such, the P sensors 220F, 220C, and 220R may be used as pattern concentration detector.

As shown in FIG. 5, the concentration correction patterns 201F and 201R may be rectangular-shaped toner patches, wherein the concentration of the rectangular-shaped toner patches may be changed gradually. Further, the positional deviation correction patterns 202F and 202R may be formed at a position after the concentration correction patterns 201F and 201R, wherein the positional deviation correction patterns 202F and 202R may be a combination of four lines. Accordingly, the concentration correction patterns 201F and 201R include a plurality of rectangular-shaped toner patches arranged in one row with a given interval along a traveling (or rotating) direction of the intermediate transfer belt 3. The positional deviation correction patterns 202F and 202R may include a combination of four lines of YMCK (yellow, magenta, cyan, black) extending in a main scanning direction, and a combination of four lines of YMCK extending in a direction slanted from the main scanning direction for a given angle (e.g., 45 degrees). Such four-line images may be formed setting a given interval between the four-line images.

Further, a concentration correction pattern and a positional deviation correction pattern, formed at the image not-forming area 203*a*, may be similarly formed at a center portion of the image forming area 203 although not shown. Further, a cleaning blade 210 (see FIG. 5) may remove toner remaining on the intermediate transfer belt 3 after an image forming operation.

An image forming operation, transfer operation, fixing operation, and cleaning operation for the image forming apparatus using a tandem arrangement is known for those skilled in the art.

Figure 6A:
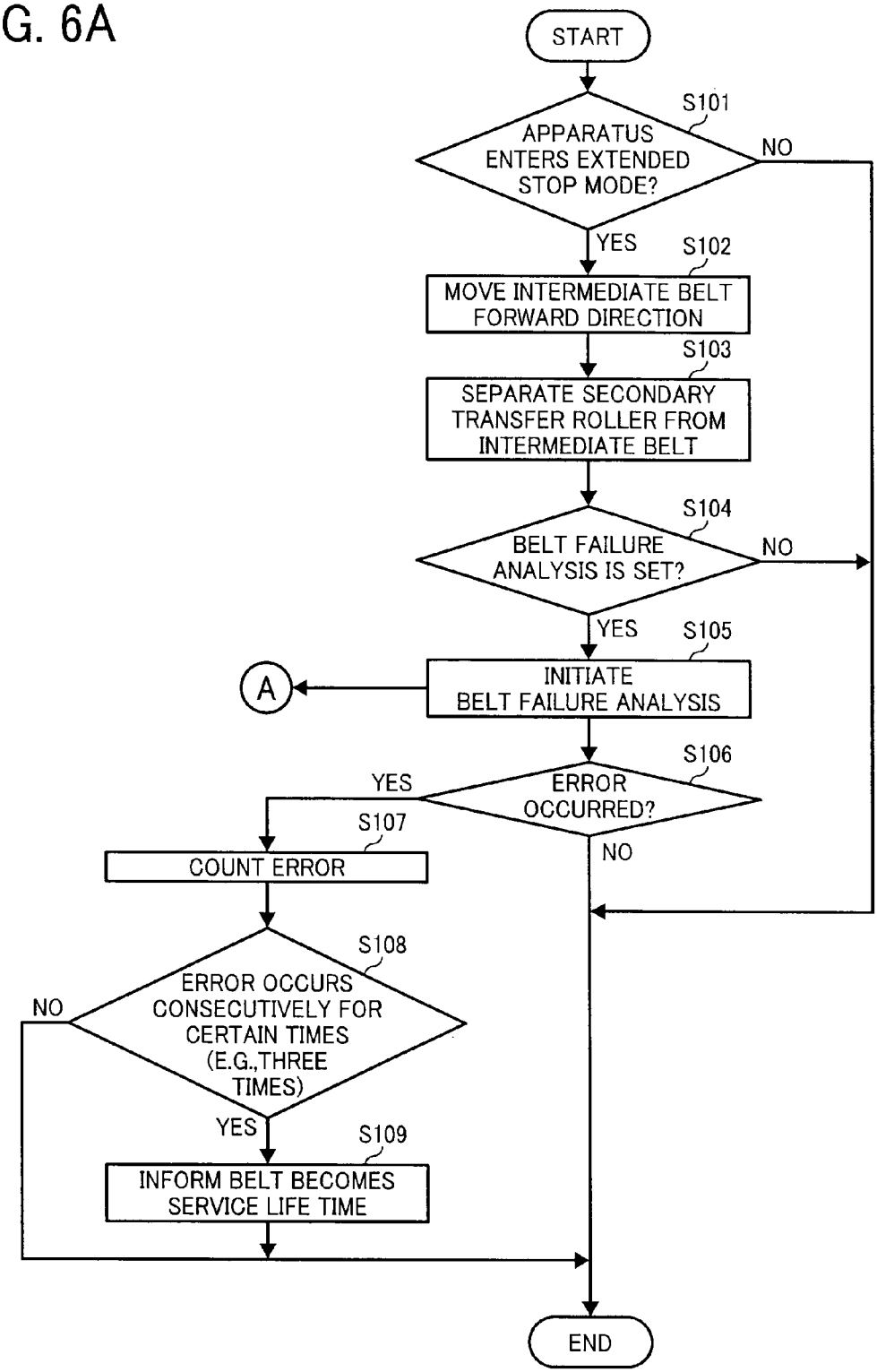
FIG. 6A is a flow chart showing a process for preventing undesirable phenomenon of curling of the intermediate transfer belt according to an exemplary embodiment.

FIG. 6A is a flowchart showing a process for preventing or suppressing undesirable phenomenon called curling of the intermediate transfer belt 3. Such process can be conducted when the CPU 121 executes a given program stored in the ROM 122 using the RAM 123 as a working area, for example.

At step S101, it is checked whether the intermediate transfer belt 3 will enter an extended stop mode. If the intermediate transfer belt 3 enters the extended stop mode, the intermediate transfer belt 3 will be stopped for a long period of time. The intermediate transfer belt 3 may be stopped for a long period of time when the image forming apparatus is stopped after a last image forming operation, or when the image forming apparatus is shifted to an energy-saving mode.

However, the CPU 121 cannot determine whether the image forming apparatus is stopped for a long period of time after a last image forming operation because a next image forming operation may be conducted at any time after the last image forming operation. In view of such situation, the CPU 121 may be provided with a timer for counting an elapsed time elapsing after the last image forming operation. By using the timer, the CPU 121 can count the elapsed time and check whether the intermediate transfer belt 3 is stopped for a long period of time based on a count value of timer. For example, one given time period may be set in advance, and the CPU 121 checks whether the count value of timer becomes the given time period. If the count value of timer becomes the given time period, it is determined that the image forming apparatus enters the extended stop mode.

Further, if the image forming apparatus is shifted to an energy-saving mode, the CPU 121 determines that the intermediate transfer belt 3 will be stopped for a long period of time and enters the extended stop mode.

As such, if it is determined that the intermediate transfer belt 3 enters the extended stop mode (step S101: YES), the intermediate transfer belt 3 is traveled in a forward direction for some distance and stopped at step S102.

Then, at step S103, the secondary transfer roller 6 may be separated from the intermediate transfer belt 3. Such separation can be conducted by using a mechanism using a swingable assembly to be described later. Such swingable assembly may include a motor, a gear, a cam, or the like, and a solenoid can be used instead of a motor.

Further, when a given time elapses after a completion of image forming operation, the secondary transfer roller 6 may be separated from the intermediate transfer belt 3. For example, when 10 to 15 minutes elapses after a completion of image forming operation, the secondary transfer roller 6 may be separated from the intermediate transfer belt 3. Such given time may be determined and set in advance based on types of material of the intermediate transfer belt 3, an outer diameter of the fourth support roller 3*d*, an outer diameter of the secondary transfer roller 6, for example. The given time can be changed and set using an operation panel of the operation unit 110, as required. Accordingly, the operation panel of the operation unit 110 and the CPU 121 may be used as a time setting unit which sets a start time of separation movement of the secondary transfer roller 6 from the intermediate transfer belt 3.

At step S102, the intermediate transfer belt 3 is traveled in a forward direction (or traveling direction) for some distance and stopped. With such a configuration, a stop position of the intermediate transfer belt 3 can be changed, wherein such belt moving operation may be equivalent for stopping the intermediate transfer belt 3 randomly. Accordingly, in addition to separating the intermediate transfer belt 3 from the secondary transfer roller 6, a same specific portion of the intermediate transfer belt 3 may not contact the support rollers 3*a*, 3*b*, 3*c*, and 3*d* for a long period of time. Specifically, the intermediate transfer belt 3 may not contact the fourth support roller 3*d* for a long time, by which an occurrence of curling can be prevented.

Figure 9:
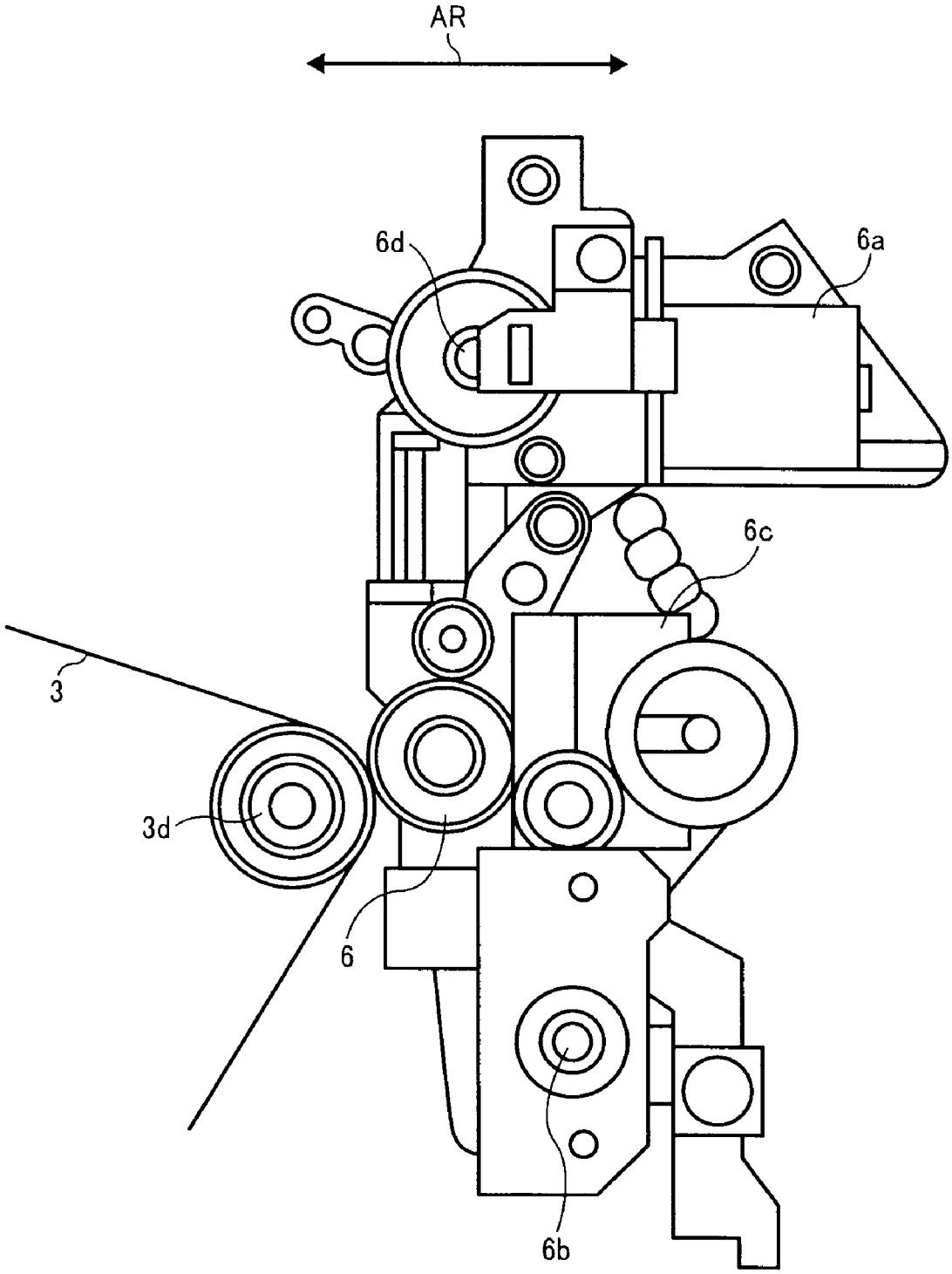
FIG. 9 shows a swingable assembly for a secondary transfer roller.

FIG. 9 shows a swingable assembly, which can abut or separate the secondary transfer roller 6 with respect to the intermediate transfer belt 3. The swingable assembly may include a base 6*c*, a support shaft 6*b*, and a motor unit 6*a*. The base 6*c* supports the secondary transfer roller 6, and the support shaft 6*b* swingably supports the base 6*c*. The motor unit 6*a* is linked to a free end side of the base 6*c*, and is used to swing the base 6*c* about the support shaft 6*b* so that the secondary transfer roller 6 can be moved closer and abutted to the fourth support roller 3*d* via the intermediate transfer belt 3, or can be separated from the fourth support roller 3*d* (see a direction shown by an arrow AR). As such, the motor unit 6*a* may be used as a swingable unit to swing the secondary transfer roller 6.

The base 6*c* may be provided with a charge controller, which controls a charging process to the secondary transfer roller 6 so that a toner image on the intermediate transfer belt 3 can be effectively transferred to a recording sheet (used as recording medium). Further, the motor unit 6*a* transmits its driving force to the base 6*c* via a speed-reduction unit, by which the secondary transfer roller 6 can be abutted or separated with respect to the intermediate transfer belt 3 effectively. The motor unit 6*a* may be controlled by the CPU 121.

When the secondary transfer roller 6 is separated from the intermediate transfer belt 3, the intermediate transfer belt 3 may not be pressed toward the support roller 3*d* by the secondary transfer roller 6, by which a portion of the intermediate transfer belt 3 pressed toward the support roller 3*d* may be relieved from a pressured condition. Accordingly, an occurrence of curling can be prevented.

After step S103, it is checked whether belt failure analysis is set for the intermediate transfer belt 3 at step S104. If the belt failure analysis is set to an enabled condition (step S104: YES), a belt failure analysis for detecting curling is started at step S105. At step S104, the CPU 121 may be used as a failure analysis setting unit.

Figure 6B:
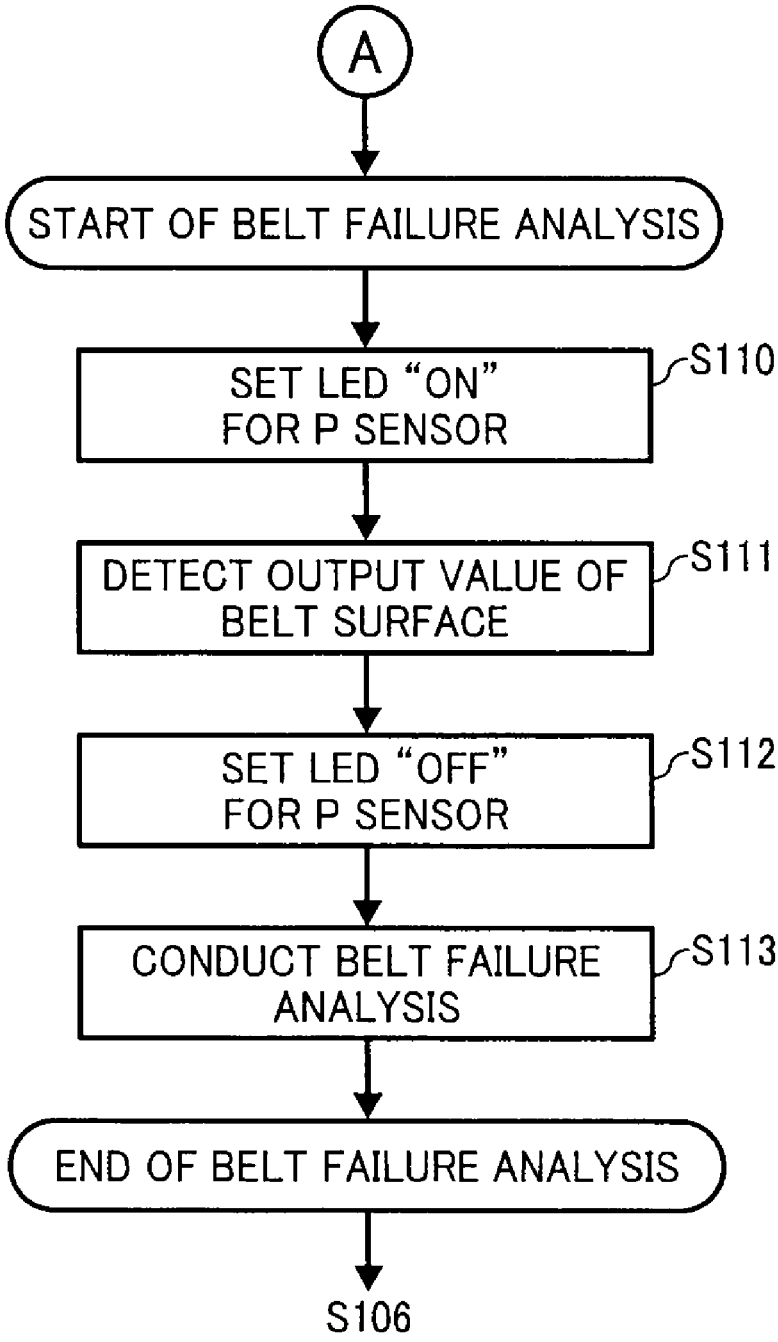
FIG. 6B is a flow chart showing a process for conducting a belt failure analysis.

The detail of the belt failure analysis is shown in a flowchart of FIG. 6B. As shown in FIG. 6B, at step S110, light emitting diode (LED) of the P sensors 220F, 220C, and 220R are set to "ON." Reflection light reflecting from the concentration correction pattern 201 and the positional deviation correction pattern 202 may be received by a photodiode PD provided in the P sensors 220F, 220C, and 220R, and output values of the P sensors 220F, 220C, and 220R are detected for one rotation of the intermediate transfer belt 3 at step S111. When a detection of output value for one rotation of the intermediate transfer belt 3 is completed, the LED is set to "OFF" at step S112, and then a belt failure analysis is conducted at step S113. At step S113, the CPU 121 is used as a failure determination unit.

In the belt failure analysis, a belt failure may be determined by referring an upper limit and lower limit of output values of the P sensors 220F, 220C, and 220R. For example, if the output values are within a given range (e.g., from 3500 mv to 4500 mv), it is determined that the intermediate transfer belt 3 is in a normal condition, and if the output values are not within such range, it is determined that the intermediate transfer belt 3 has abnormal condition (i.e., curling occurs).

Figure 7:
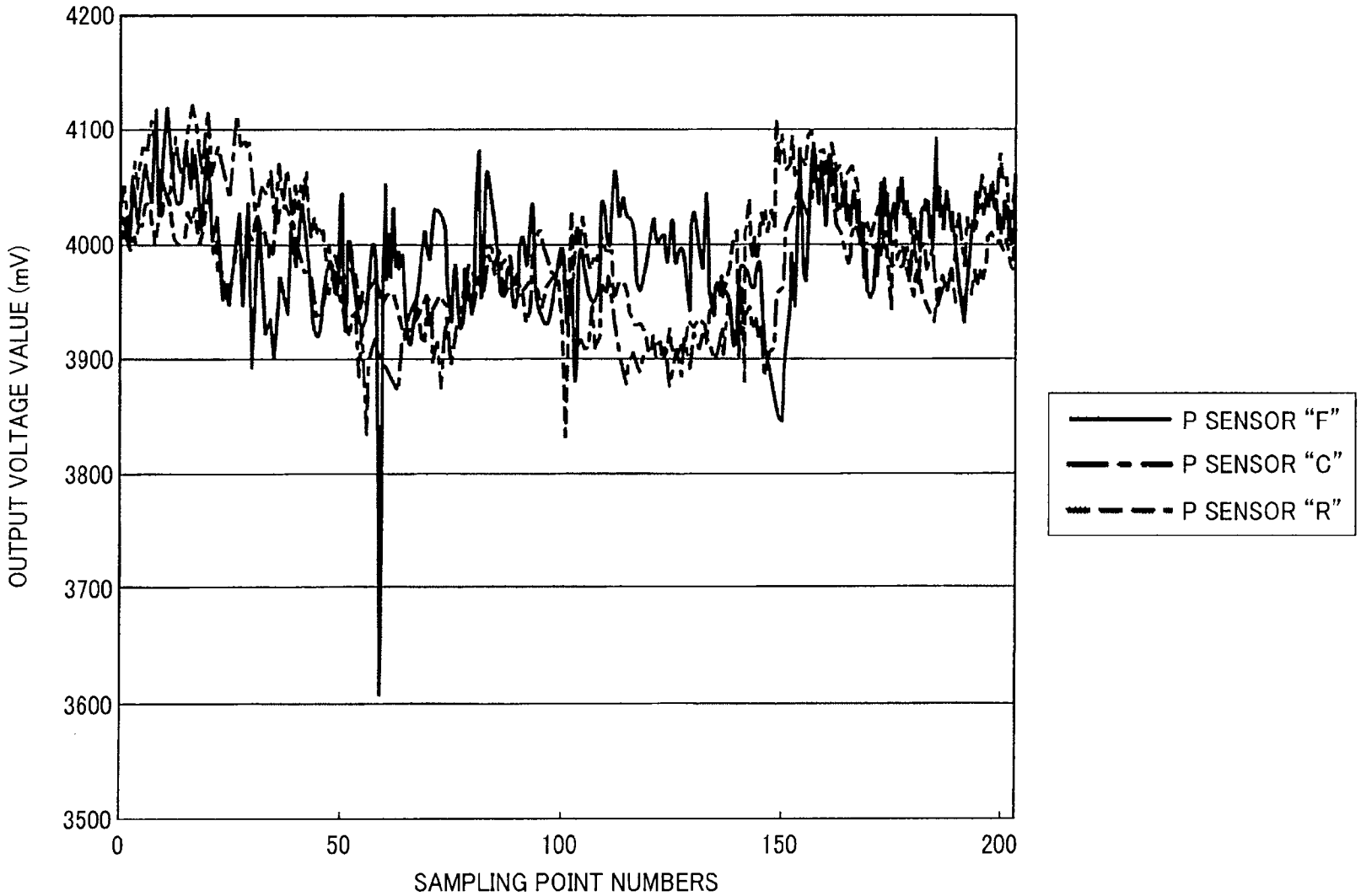
FIG. 7 shows detection results of output values of P sensors disposed at a front side, a center portion, and a rear side of the intermediate transfer belt.

FIG. 7 shows example detection results of output values of the P sensors 220F, 220C, and 220R. A detection result for the P sensor 220F (i.e., sensor at front side) is shown by a solid line, a detection result for the P sensor 220C (i.e., sensor at center portion) is shown by a dashed line, and a detection result of the P sensor 220R (i.e., sensor at rear side) is shown by a chain line. In FIG. 7, the lowest detection value of the P sensor 220F becomes relatively greater but is still within the normal value range, and all output values of the P sensors 220F, 220C, and 220R are within the range of from 3500 mv to 4500 mv. Accordingly, it can be determined that the intermediate transfer belt 3 has no undesirable phenomenon of curling. As such, the P sensors 220F, 220C, and 220R may be used as curling detector under a control of the CPU 121.

After such process, at step S106, it is checked whether an error condition has occurred on the intermediate transfer belt 3 at step S106. If no error occurs (step S106: NO), the belt failure analysis ends. If one of the output values of the P sensors 220F, 220C, and 220R are not within the range of from 3500 mv to 4500 mv, it is determined that an error occurs, and the number of error is counted as "one" at step S107. As such, an error condition of the intermediate transfer belt 3 can be checked by the processes of steps S101 to steps S106.

If such error condition of the intermediate transfer belt 3 is counted for a given number of times consecutively, it is determined that the intermediate transfer belt 3 becomes service lifetime. Specifically, at step S108, it is checked whether the error condition occurs on the intermediate transfer belt 3 for a given number of times consecutively. If error condition is counted for a given number of times (e.g., three times) consecutively (step S108: YES), the intermediate transfer belt 3 is determined to become service lifetime, which means the intermediate transfer belt 3 may be required to be replaced. Such service life (or replacement) condition is then informed or indicated to the service center 300 at step S109. Further, such service life (or replacement) condition can be displayed on the operation panel of the operation unit 110. As such, at step S109, the operation unit 110 having the operation panel and the service center 300 may be used as replacement indicator unit.

At step S108, it is determined that the intermediate transfer belt 3 becomes a service lifetime when error is detected consecutively for a given number of times. Such number can be changed by adjusting a normal value range set for output value of P sensors, and depending on character of the intermediate transfer belt 3, and image failure to be determined by using a given image concentration level as a threshold value, for example.

Each step in FIGS. 6A and 6B may use initial values, which may be set as operating conditions for an apparatus, wherein such initial values may be set when power is supplied (e.g., power supply is set to ON). Further, an operator or user can change and set such initial values as required in view of actual usage of image forming apparatus. Accordingly, the operator or user can set following operating conditions using the operation panel of the operation unit 110. Such operating conditions may be a setting for automatic separation operation of the secondary transfer roller 6 for separating the secondary transfer roller 6; a setting of time period to determine whether the extended stop mode is set for the image forming apparatus at step S101; a setting of forward movement distance of the intermediate transfer belt 3 at step S102; a setting of separation time used for separating the secondary transfer roller 6 at step S103; a setting of belt failure analysis at step S105; and a setting of the number of errors at step S108, for example. At step S108, the operation unit 110 having an operation panel may be used as a detection number setting unit under a control of the CPU 121.

Figure 8A:
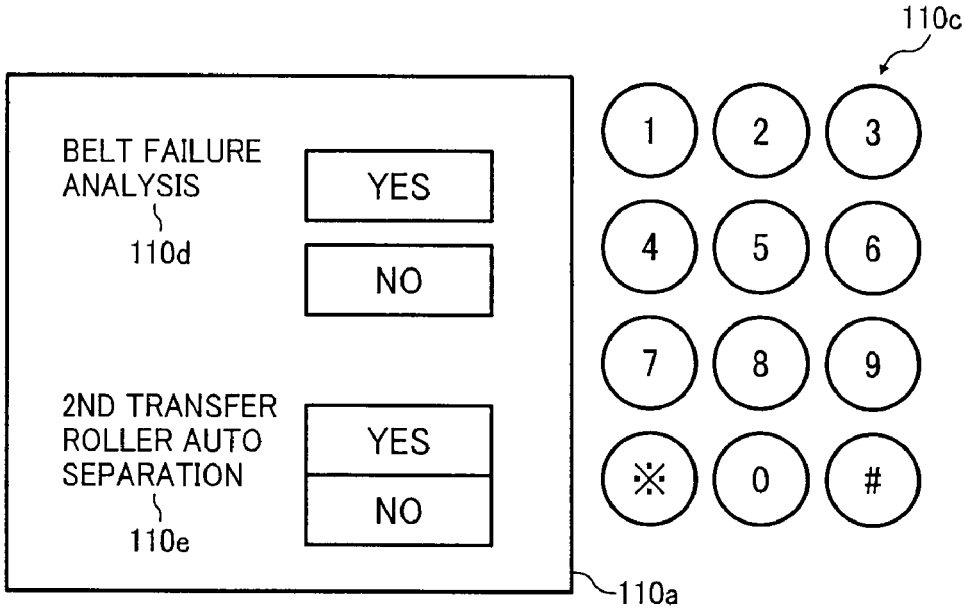
FIG. 8A and FIG. 8B show example screen shots of operation panel used for inputting a given setting.

FIG. 8 shows an example screen shot of an operation panel, which may be used to set the above-described settings. For example, an operator or a user may input give setting values to the image forming apparatus using the operation panel. FIG. 8A shows an example screen shot of operation panel, which can select a belt failure analysis of the intermediate transfer belt 3 and an automatic separation of the secondary transfer roller 6. FIG. 8A shows an operation screen 110*a*, which appears when a separation of the secondary transfer roller 6 is selected on an initial screen (not shown). Such operation screen 110*a* may be a touch panel, for example. If a button displayed on the operation screen 110*a* is touched or pressed, a command displayed on the button can be input. In FIG. 8A, the operation screen 110*a* displays "Belt Failure Analysis" 110*d* and "2nd Transfer Roller Auto Separation" 110*e*, and each of which have input buttons of "YES" and "NO".

The "Belt Failure Analysis" 110*d* is used to select whether a belt failure analysis is to be conducted. The "2nd Transfer Roller Auto Separation" 110*e* is used to select whether an automatic separation operation is to be conducted for the secondary transfer roller 6. As such, the operation panel 110*a* may be used as a separation setting unit under a control of the CPU 121.

When the "YES" or "NO" button is touched or pressed for the "Belt Failure Analysis" 110*d*, it is determined whether the belt failure analysis is to be conducted, and when the "YES" or "NO" button is touched or pressed for "2nd Transfer Roller Auto Separation" 110*e*, it is determined whether the automatic separation operation is to be conducted for the secondary transfer roller 6.

When the "YES" or "NO" button is touched or pressed for the "Belt Failure Analysis" 110*d* and "2nd Transfer Roller Auto Separation" 110*e*, a next screen key (not shown) displayed on the operation screen 110*a* is pressed to show a next screen.

Figure 8B:
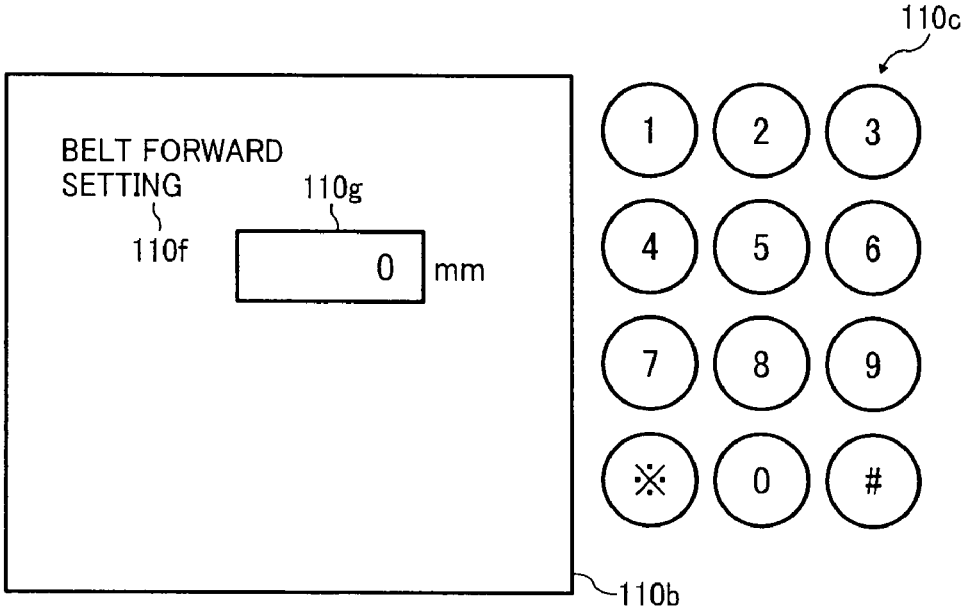

As shown in FIGS. 8A and 8B, the operation screen 110*a* may be provided with hard keys such as ten key 110*c*, by which numeric value can be input or selected.

Further, FIG. 8B shows an operation screen 110*b* for belt forward setting, wherein the operation screen 110*b* can be shown by pressing the next screen key (not shown) on the operation screen 110*a* of FIG. 8A, for example. The operation screen 110*b* displays the "Belt Forward Setting" 110*f* and a window 110*g*, which is used to input a forward movement distance of belt. A forward movement distance of belt can be set by inputting a given numeric value in the window 110*g* using the ten key 110*c*. As such, the operation panel 110*b* can be used as a movement distance setting unit under a control of the CPU 121.

When a next screen key, not shown but displayable on the operation screen 110*b*, is pressed, another screens may be similarly displayed sequentially to set a separation time for separating the secondary transfer roller 6, and to set the number of the errors used for belt failure analysis as similar to the above described process shown in FIGS. 8A and 8B. When all concerned settings are input, an enter key may be pressed to start a process shown in FIGS. 6A and 6B.

As for the above-described process, if "NO" is selected for "Belt failure analysis" 110*d*, steps S110 to step S113 are skipped. If "NO" is selected for "2nd Transfer Roller Auto Separation" 110*e*, some process shown in FIGS. 6A and 6B may be cancelled, by which a separation of the secondary transfer roller 6 is not conducted. Further, depending on information selected on one screen of the operation unit 110, a display message or content to be appeared on a next screen may be changed. Further, the CPU 121 in the engine control unit 120 may control a displaying style of operation screen of the operation unit 110 as exemplary shown in FIGS. 8A and 8B.

In the above described exemplary embodiments, pressure applied to the intermediate transfer belt 3 from the secondary transfer roller 6 can be reduced, by which an occurrence of undesirable phenomenon called curling of the intermediate transfer belt can be prevented or suppressed.

In the above described exemplary embodiments, an occurrence of curling of the intermediate transfer belt 3 can be detected, by which a replacement of the intermediate transfer belt 3 can be informed or indicated to a relevant unit or person at a given suitable timing.

In the above described exemplary embodiments, an occurrence of curling of the intermediate transfer belt 3 can be detected, by which belt failure condition such as for example a failure level of curling can be determined.

In the above described exemplary embodiments, an occurrence of curling of the intermediate transfer belt 3 can be detected, by which a service lifetime of the intermediate transfer belt 3 can be determined based on a failure level of curling.

In the above described exemplary embodiments, the occurrence of curling of the intermediate transfer belt 3 can be prevented or suppressed, and a replacement timing (or service lifetime) of the intermediate transfer belt 3 can be informed or indicated, and a failure level of image forming apparatus can be informed or indicated before an image failure actually occurs. More specifically, a failed condition of the intermediate transfer belt 3 can be informed or indicated and solved at a time well before an actual image failure occurs. Accordingly, the image forming apparatus according to exemplary embodiments can prevent an occurrence of image failure.

In the above described exemplary embodiments, when the intermediate transfer belt 3 is to be stopped for a long period of time, the intermediate transfer belt 3 can be moved in a transport direction for a given distance, and then the intermediate transfer belt 3 can be separated from the secondary transfer roller 6 (or secondary transfer unit), by which a pressure may not be applied to the intermediate transfer belt 3 from the secondary transfer roller 6, by which an occurrence of curling of the intermediate transfer belt can be prevented or suppressed, and image failure can be prevented.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a primary transfer unit to primary-transfer an image from an image carrying member to an intermediate transfer belt;

a secondary transfer unit to secondary-transfer the image, primary-transferred onto the intermediate transfer belt, from the intermediate transfer belt to a recording medium;

a belt drive unit to drive the intermediate transfer belt; and a swingable assembly to alternately abut the secondary transfer unit to the intermediate transfer belt and separate the secondary transfer unit from the intermediate transfer belt, wherein, when the image forming apparatus is determined to be shifted to an extended stop mode, the belt drive unit moves the intermediate transfer belt for a given distance in a transport direction of the intermediate transfer belt and the swingable assembly separates the secondary transfer unit from the intermediate transfer belt.

2. The image forming apparatus according to claim 1, wherein the extended stop mode includes one of 1) when a given time elapses after the intermediate transfer belt is stopped after completing an image forming operation, and 2) when the image forming apparatus enters an energy-saving mode.

3. The image forming apparatus according to claim 1, further comprising a movement distance setting unit to set the given distance for moving the intermediate transfer belt in the transport direction of the intermediate transfer belt.

4. The image forming apparatus according to claim 1, further comprising a separation setting unit to determine whether to separate the intermediate transfer belt from the secondary transfer unit.

5. The image forming apparatus according to claim 4, further comprising a time setting unit to set a start time of separation of the secondary transfer unit from the intermediate transfer belt when the separation setting unit determines to separate the secondary transfer unit from the intermediate transfer belt.

6. The image forming apparatus according to claim 1, further comprising:

a concentration correction pattern forming unit to form a concentration correction pattern on the intermediate transfer belt;

a pattern concentration detector to detect concentration of the concentration correction pattern; and a curling detector to detect curling of the intermediate transfer belt based on a detection result of the pattern concentration detector.

7. The image forming apparatus according to claim 6, further comprising:

a replacement indicator unit to indicate replacement of the intermediate transfer belt is recommended when the curling detector detects curling a given consecutive number of times.

8. The image forming apparatus according to claim 6, further comprising a failure determination unit that checks the intermediate transfer belt for failure and which determines that the intermediate transfer belt is in a failed condition when the curling detector detects curling a given consecutive number of times.

9. The image forming apparatus according to claim 8, further comprising a failure analysis setting unit to determine whether or not the failure determination unit conducts an intermediate transfer belt failure determination.

10. The image forming apparatus according to claim 7, further comprising a detection number setting unit to set the given number of times that curling is detected consecutively.

11. The image forming apparatus according to claim 1, wherein the secondary transfer unit includes a secondary transfer roller.

12. A drive control method for an intermediate transfer belt for an image forming apparatus, in which an image is primary-transferred from an image carrying member to the intermediate transfer belt, the image being secondary-transferred from the intermediate transfer belt to a recording medium using a secondary transfer unit, the method comprising:

moving the intermediate transfer belt for a given distance in a transport direction of the intermediate transfer belt when the image forming apparatus is shifted to an extended stop mode; and separating the secondary transfer unit from the intermediate transfer belt after moving the intermediate transfer belt for a given distance in a transport direction of the intermediate transfer belt when the image forming apparatus is shifted to the extended stop mode.

13. The method according to claim 12, wherein the extended stop mode includes one of 1) when a given time elapses after the intermediate transfer belt is stopped after completing an image forming operation, and 2) when the image forming apparatus enters an energy-saving mode.

14. The method according to claim 12, further comprising:

forming a concentration correction pattern on the intermediate transfer belt;

detecting concentration of the concentration correction pattern; and detecting curling of the intermediate transfer belt based on a concentration detection result of the concentration correction pattern.

15. The method according to claim 14, further comprising:

indicating replacement of the intermediate transfer belt is recommended when curling is detected a given consecutive number of times.

16. The method according to claim 15, further comprising:

determining that image forming apparatus is in a failed condition when the curling is consecutively detected for a given number of times.

17. A non-transitory computer-readable storage medium storing computer-readable program codes embodied in the computer-readable storage medium for controlling an intermediate transfer belt used for an image forming apparatus, the computer-readable program codes that, when executed by a computer, instruct a controller to execute a method of controlling the intermediate transfer belt used for an image forming apparatus, in which an image is primary-transferred from an image carrying member to the intermediate transfer belt, the image being secondary-transferred from the intermediate transfer belt to a recording medium using a secondary transfer unit, the method comprising:

moving the intermediate transfer belt for a given distance in a transport direction of the intermediate transfer belt when the image forming apparatus is shifted to an extended stop mode; and separating the secondary transfer unit from the intermediate transfer belt after moving the intermediate transfer belt for a given distance in the transport direction of the intermediate transfer belt when the image forming apparatus is shifted to the extended stop mode.

18. The non-transitory computer-readable storage medium according to claim 17, wherein the extended stop mode includes one of 1) when a given time elapses after the intermediate transfer belt is stopped after completing an image forming operation, and 2) when the image forming apparatus enters an energy-saving mode.

* * * * *